United States Patent [19]

Bronfenbrenner et al.

[11] Patent Number: 4,555,248

[45] Date of Patent: Nov. 26, 1985

[54] PROCESS FOR STABILIZING THE VISCOSITY CHARACTERISTICS OF COAL DERIVED MATERIALS AND THE STABILIZED MATERIALS OBTAINED THEREBY

[75] Inventors: James C. Bronfenbrenner; Edward P. Foster; Krishna Tewari, all of Allentown, Pa.

[73] Assignee: International Coal Refining Company, Allentown, Pa.

[21] Appl. No.: 622,371

[22] Filed: Jun. 20, 1984

[51] Int. Cl.[4] ..... C10L 1/18

[52] U.S. Cl. ..... 44/78; 44/51

[58] Field of Search ..... 44/78, 51

[56] References Cited

U.S. PATENT DOCUMENTS

| | | | |
|---|---|---|---|
| 2,257,079 | 2/1942 | Story et al. | 44/78 |
| 2,275,175 | 3/1942 | Cloud | 44/78 |
| 2,980,519 | 4/1961 | Nixon et al. | 44/78 |
| 3,019,097 | 1/1962 | Ecke et al. | 44/78 |
| 3,305,522 | 2/1967 | Spacht | 44/78 |

*Primary Examiner*—Y. Harris-Smith

[57] ABSTRACT

A process is disclosed for stabilizing the viscosity of coal derived materials such as an SRC product by adding up to 5.0% by weight of a light volatile phenolic viscosity repressor. The viscosity will remain stabilized for a period of time of up to 4 months.

12 Claims, No Drawings

PROCESS FOR STABILIZING THE VISCOSITY CHARACTERISTICS OF COAL DERIVED MATERIALS AND THE STABILIZED MATERIALS OBTAINED THEREBY

The Government of the United States of America has rights in this invention pursuant to Contract No. DE-AC05-780R03054 (as modified) awarded by the U.S. Department of Energy.

BACKGROUND AND SUMMARY OF THE INVENTION

The present invention relates generally to the rheology and storage stability of coal derived materials. More particularly, it is concerned with a process for stabilizing the viscosity characteristics of coal derived fluid and fluid blend materials and with the stabilized materials obtained thereby.

The viscosity instability of certain coal derived fluid materials has caused substantial problems in the handling, storage, and utilization of these materials. The instability can result in a viscosity increase to levels greater than 10,000 cP in a matter of days thereby preventing the pumping and use of the material as a boiler fuel. Heretofore this instability has been attributed to oxidative aging; however, known oxidation inhibitors for petroleum-derived materials are ineffective to stabilize the viscosity of the coal derived fluid materials.

The materials of primary concern are the materials referred to as the residual oils of the solvent refined coal (SRC) process. These SRC residual oils are homogenous single-phase blends of SRC distillate liquids having a boiling range of 200°-455° C. and deashed SRC products having a boiling range in excess of 455° C. derived from the first and second stages of the SRC process. The residual oil blends may be solid at ambient temperature and typically are heated and stored at elevated temperatures of about 65°-120° C. where, in the liquid state, they exhibit homogeneity and Newtonian behavior that permits their use as a No. 6 fuel oil substitute in conventional fuel handling equipment. For such use, the viscosity characteristics of the residual oils must be such as to facilitate pumping and proper atomizing of the fuel. As mentioned, it has been extensively reported that coal derived liquids of this type are very susceptible to oxidative degradation or aging that dramatically increases their viscosity thereby adversely affecting the pumping and atomizing temperatures of the residual oils. It is therefore essential that the viscosity characteristics of the materials be maintained within acceptable limits during storage for periods of four months and longer.

In accordance with the present invention, it has been found that SRC residual oils tend to lose their volatile low boiling constituents during blending, handling, and storage and that such loss results in an irreversible increase in viscosity that far exceeds any increase that might be expected simply from concentration changes. It is believed that these volatile constituents loosely associate with nitrogen containing molecules in the oils to control the viscosity during prolonged storage. Loss of these constituents tends to free the nitrogen containing materials to associate with heavier acidic molecules thus forming high molecular weight species of increased viscosity. The reaction forming these high molcular weight species is not reversible and therefore, it is believed, the petroleum-derived inhibitors are ineffective in stabilizing the viscosity of the residual oils after loss of the light volatile components.

The present invention provides a process for maintaining a stabilized viscosity by minimizing the loss of the light volatile components of the residual oils so as to prevent the high molecular weight acid/base aggregation and the resultant irreversible increase in viscosity associated therewith.

Those attributing the viscosity instability to oxidative aging have suggested blanketing the residual oils with an inert atmosphere such as nitrogen. While partially effective, even this technique does not prevent the loss of some of the necessary volatile components during the transfer of the residual oils between various storage facilities. As can be appreciated, even when extreme care is taken during transfer, the vapor of the volatile components will equilibrate within the vapor space in the new storage vessel. In accordance with the present invention, even this slight loss can be minimized, if not essentially eliminated.

In accordance with the present invention, it has been found that the suppression of the volatilization of low boiling components within the residual oil will be effective to maintain the viscosity of the oil at its desired low value without significantly diluting the oil. A benefit of this procedure is the increase in the amount of SRC used in the blend. With this new technique it can be increased above the 35 percent concentration used heretofore while extending the storage times well beyond that experienced for such materials. The volatile components typically are present in rather low concentrations such that viscosity stability of the blend can be maintained for extended periods of time through the use of equally low concentrations of a viscosity repressor. This process is designed for high efficiency of operation while minimizing loss of the volatile constituents and therefore minimize viscosity increases.

Other advantages and features will be in part obvious and in part pointed out more in detail hereinafter.

These and related advantages may be achieved in accordance with the present invention by providing a proces for stabilizing the viscosity of homogenous coal derived fluid and fluid blend materials during handling and storage at temperatures of as low as 35° C. and as high as 150° C. for a period of time up to about four months by blending a coal derived material, adding to the coal derived material a volatile phenolic viscosity repressor, feeding the coal derived material to a storage container while minimizing the loss of volatile components therein and maintaining a partial pressure of said phenolic viscosity repressor over said coal derived material during storage.

A better understanding of the invention will be obtained from the following detailed description of the process including the several steps and the relation of one or more of such steps with respect to each of the others and the product obtained therefrom possessing the features, characteristics, compositions, properties, and relation of elements described and exemplified herein.

DESCRIPTION OF A PREFERRED EMBODIMENT

As mentioned hereinbefore, the present invention provides a technique for stabilizing the viscosity of coal derived fluid materials through judicious handling of those materials coupled with the utilization of a light, volatile phenolic viscosity repressor capable of maintaining the viscosity of the fluid in a stabilized condition for a period of at least four months. As used herein, stabilization of the viscosity of the coal derived materials is considered to be achieved when the increase in viscosity experienced during prolonged storage or aging can be offset by increasing the temperature of that material by about 6° C. Accordingly, if the viscosity of a fluid material stored at a temperature in the range of 35°-150° C. and preferably about 65°-120° C. increases during storage and an increase in the temperature of the material by about 6° C. can return the material to its original viscosity, then the material is considered stabilized. As can be appreciated, certain increases in viscosity are to be anticipated during storage and these increases will not be considered as evidencing instability unless the increase is such as to prevent a return of the viscosity to its original level by means of a temperature increase of about 6° C. In this way, the viscosity characteristics and hence the pumping and atomization temperatures of the residual oil materials can be maintained within a limited temperature range for an extended period of time thereby permitting handling, transportation, and storage of the material without adversely affecting its performance characteristics.

As mentioned, the invention is primarily concerned with the rheology and storage stability of various SRC residual fuel oils. These materials are homogenous, single-phase blends of SRC distillate liquids and SRC product obtained from the first and second stages of the SRC liquefaction process. The fluid characteristics of these SRC residual oils depend on the characteristics of the solid material including its average molecular weight and on the amount and type of distillate liquids used in the blends. Optimum compositions for the blends enable the material to be used in place of fuels such as No. 6 fuel oil in conventional fuel handling equipment. Thus, the material must exhibit appropriate pumping and atomizing characteristics. For example at about 105° C. the viscosity of the blend should be below 1000 cP to facilitate pumping and at up to 165° C., the viscosity must be below 30 cP to properly atomize the fuel using conventional No. 6 fuel oil atomizers.

The SRC typically has a boiling range in excess of 455° C. and can include refined coal products such as the light intermediate stream derived from the Kerr-McGee deashing process, the heavy first stage SRC product recovered from the SRC process after the Kerr-McGee deashing or the SRC product derived from the two stage hydrocracking or the catalytic hydrogenation operation; for example, in U.S. Pat. No. 4,164,466. The pumping and atomizing temperatures of the blends depend on the type and amount of SRC used in the blend and those temperatures increase as the SRC material utilized changes from the light intermediate stream to the two-stage liquefaction SRC to the heavy first stage SRC product.

The liquids used to dissolve the SRC phase when forming the SRC residual oil blends typically include the middle oil distillate fraction from the first stage of the SRC process. Such liquids have a boiling point range of 200°-345° C. The heavy oil distillate fraction from the first stage of the SRC process having a boiling point range of 345°-455° C. and the process solvent liquids obtained from the first and second stages of the SRC process and having a boiling point range of 235°-455° C. may also be employed.

When blending solid SRC material, it typically is pulverized to less than 200 mesh so that it will dissolve rapidly in the middle oil or process solvent at blending temperatures below the SRC melting point of 150°-200° C. The blending temperature typically is from 80°-105° C. It is preferred that the maximum blending temperature be below the flashpoint of the solvent to minimize volatile losses and the minimum temperature is chosen to insure a blend viscosity of substantially less than 1,000 cP so that the mixing achieved through limited circulation is all that is required to dissolve the solid SRC product rapidly. The SRC can also be blended in its liquid form at higher temperatures.

By appropriate combinations of the SRC and solvent materials, it is possible to achieve maximum fuel efficiency. Thus, as can be appreciated, the SRC/liquid weight ratio within the blends may extend from 10-90 to 90-10; although the preferred blends typically have a SRC content within the range of 30-70 percent by weight. The SRC/liquid ratios of at least 40/60 of the heavy first stage SRC product and the middle oil possess viscosity/temperature characteristics substantially similar to or better than those of the No. 6 fuel oil. Accordingly, for purposes of illustration and ease of understanding the remaining discussion with respect to viscosity characteristics will refer to the blends which utilize these materials unless otherwise specified. In this connection, it should also be appreciated that the SRC content of the blend will preferably be at least 40 percent by weight with most blends being formed with an SRC content of about 50-55 percent by weight. As will be appreciated, other specific process streams may be utilized including atmospheric and vacuum flash bottoms from first and second stages of the SRC process as well as equivalent coal derived materials from other processes. The invention also has application to the stabilization of coal derived materials being processed and handled at significantly higher temperatures up to 350° C. including vacuum tower bottoms and other feedstreams.

The coal derived liquid materials inherently contain a low percentage of oxygen in the form of phenols and a lesser amount of nitrogen bases. The phenols predominate in the less than 260° C. cut of the distillate oil and decrease as the boiling range of that material increases. Accordingly, the middle and heavy oils used for the residual oils do not have as high a concentration of phenols as the light SRC oil. Conversely, the nitrogen bases are highest in the high boiling distillate oils and residues and decrease with decreasing boiling point with some of the heavier nitrogen bases being hydrolized. These bases are reported by Paudler and Chiplen in FUEL, Vol. 58, p.775-78, November 1979. The hydrogen bonding of the phenols and water with the nitrogen bases is important in determining the viscosity of the coal derived materials, with the size and concentration of the proton transfer complexes determining how high the viscosity will be.

In accordance with the present invention, it has been found that the most desirable viscosity repressors are the light volatile phenols having a boiling point below 260° C. and that these volatile, low boiling materials are particularly effective for maintaining the viscosity of the residual oil at as low a level as possible. Phenol, methyl phenol, and dimethyl phenol ar present in relatively low concentrations of only about 1-2 percent by weight in the residual oils and are preferentially bound with nitrogen bases that are present in concentrations of less than 1 percent. When any of these light phenols are volatilized, the free nitrogen bases associate with a higher molecular weight phenol which is then present in an excess amount thereby causing the viscosity to irreversibly increase.

The phenolic viscosity repressor used in accordance with the present invention includes not only phenol but also the alkyl-substituted phenols and various mixtures thereof. The alkyl radicals in the substituted phenols have from 1 to 5 carbon atoms. These lower alkyl groups may be mono or di substituted. Accordingly, the alkyl phenols may include the various cresols as well as the dimethyl, ethyl, propyl and butyl substituted phenols. Although these phenolic ingredients may be used alone as the viscosity repressor, it is also possible to use mixtures thereof including the SRC light oil having a boiling point in the range of 145°-260° C. since the light oil distillate is rich in these low boiling phenols. The light oil is the first of two liquid fractions recovered from the SRC process using vacuum and atmospheric fractionating columns. This fraction is typically referred to as the less than 230° C. fraction and is recovered as the overhead product of the fractionating column as contrasted with the greater than 230° C. fraction which is removed as a side draw product from the vacuum column. The light oil constitutes from 5-30 percent by weight of the total recovered liquids and typically has a final boiling point of 230°-260° C. as contrasted with the final boiling points of the middle oil at 345° C. and the higher boiling heavy oil utilized in the blending operation.

As can be appreciated, the amount of phenolic viscosity repressor utilized in accordance with the present invention will vary depending upon the particular blend of the residual oil. Typically 0.1 to 5 percent by weight may be employed. However, it has been found that additions of about 0.5-2.0 percent by weight are sufficient under most handling and storage conditions to provide the necessary viscosity stabilization. In the preferred embodiment, about 1.0-2.0 percent by weight of the phenolic viscosity repressor is used, although larger amounts may be used in those instances where the resultant dilution would not have an adverse effect on the desired characteristics of the end product. As can be appreciated, the addition of 1 percent of viscosity repressor will result in a greater decrease in viscosity than would have been expected from dilution of the oil. Although quantities of the phenolic viscosity repressor may range up to 5 percent or more, the amount necessary for maintaining the viscosity of the residual oil at the appropriate level is achieved within the preferred quantity range and the excess amount adds little beyond its dilution effect.

As mentioned hereinbefore, the process of the present invention involves not only the use of a phenolic viscosity repressor but also involves handling techniques whereby the materials are processed, blended, and stored in such a manner as to retain and miminize the loss of the light volatile components therein. These techniques include the utilization of an inert or low oxygen atmosphere with minimal agitation of the blend during handling and storage as well as the utilization of equipment systems such as reflux vented condensers which vent only the non-condensibles and reinject or return the condensibles to the fluid blend. As can be appreciated, even under such conditions there will still be a small increase in the viscosity of the coal-derived materials since a small amount of the volatile components will be vaporized when equilibrating with the vapor space within the various containers. However, even this loss can be essentially eliminated through the appropriate use of the phenolic viscosity repressor incorporated in accordance with the present invention. As will be appreciated, the aforementioned handling techniques can be used simultaneously as well as separately and in fact simultaneous use of the various techniques is preferred.

The blanketing of the residual oil blends can take the form of an appropriate inert atmosphere such as nitrogen or an atmosphere having a low oxygen content. An equivalent affect may be obtained through the use of a floating roof vessel which essentially eliminates the vapor space above the blend during storage. Alternatively, when stored below about 65° C. the blend may be covered with a water layer containing a small amount of the viscosity repressor since the water layer will remain on the surface of the denser coal-derived material and prevent the volatilization of the light components within the blend. In this connection, testing was conducted where a blend of pulverizd SRC solid product having a particle size less than 200 mesh was added to the first and second stage process solvent in a weight ratio of 52:48. Where the blending was carried out with no repressor and no precautions with respect to the loss of volatile materials, the viscosity of the blend increase rapidly and within a period of 24 hours exceeded a viscosity of 10,000 cP. However, when the same materials were blended utilizing reflux vented condensers, a nitrogen atmosphere, and a minimal agitation, it was found that the blend viscosity when measured at 90° C. increased only slightly from a level of about 700 cP to a level of about 1,000 cP over a 13-day period. Although the initial viscosity increased as the samples equilibrated with the vapor space in the test vessel, the viscosity subsequently leveled off over the last five days of the test procedure. It has also been found that where identical samples of residual oil were stored at 65° C. in closed vials and open vials under an oxygen atmosphere, the magnitude of the viscosity change in the closed vials after 40-60 days was significantly less than the change in the open vials after 48-60 hours. This demonstrates that viscosity changes due to oxidative aging are very small relative to the viscosity changes incurred as a result of the loss of volatiles in SRC residual oils.

As mentioned, minimum agitation is preferred when handling and storing the residual oils. By minimizing or even eliminating agitation, air within the vapor space or entrained within the pulverized SRC products is minimized thereby reducing the oxidative aging that occurs shortly after blending. The pulverized SRC may be added through a closed solids feedport in a rapid manner to also minimize the exposure to an oxygen atmosphere. In one instance where the pulverized SRC was added to the process solvent in a weight ratio of 55:45, the addition was carried out using the preferred procedure. The addition took less than one minute while the process solvent was at 99° C. After the blend appeared homogenous, the viscosity was measured and the blend was placed in a tank truck within about 1 hour of solid addition where it was stored at 65°-82° C. for a period of 2 months. During that period, the viscosity increased from 510 to 900 cP as measured at 90° C. but this increase could be offset by an increase in temperature of less than 6° C.

As mentioned, it has been observed that excessive agitation over a prolonged period can cause substantial increase in the viscosity of the blend. As a result, it has been determined that minimum agitation should be employed and that the blending should be carried out in a completely closed system. However, minimum circulation is frequently required in order to maintain an appropriate uniform temperature and prevent build up of solids on cool surfaces in the storage container. Under these conditions, the viscosity of the SRC residual blends can be maintained in a stabilized condition with minimum viscosity increase. As can be appreciated, when transferring the residual oils between container vessels, some volatilization will occur as the material equilibrates with the new vapor space. These volatile losses can cause a viscosity increase with each transfer. This can be reduced by use of the phenolic repressor or the aforementioned floating roof tank to eliminate the vapor space. The latter is particularly useful when handling and storing at temperatures greater than 82° C. and where a layer of water containing the phenolic viscosity repressor could not be effectively used.

In this connection, it has been found that retention of the volatile components inherent in the coal derived materials will provide viscosity stabilization of the residual oil blends for periods of greater than four months when stored at temperatures of 65°-120° C.

In order that the present invention may be more readily understood, it will be further described with reference to the following specific examples which are given by way of illustration only and are not intended to be a limit on the practice of the invention.

EXAMPLE 1

In order to illustrate the viscosity changes occurring during storage about 250 grams of a residual oil sample was stored with constant stirring at 82° C. in a three-necked round bottom 500 milliliter flask equipped with a condenser and a thermometer. The storage flask was flushed with nitrogen prior to the sample transfer. To minimize loss of volatiles within the sample, a slight nitrogen back pressure was maintained at the top of the condenser. At specified intervals, a neck stopper of the flask was removed and about 10 milliliters of the sample was withdrawn for viscosity measurements at 90° C. An exposure of 5 minutes was maintained for each extraction so that the loss of vapors from vapor space of the storage flask can be assumed constant during each extraction procedure. As can be seen from the following Table I, the initial loss of volatiles in order to equilibrate the vapor space in the storage flask causes a relatively rapid increase over the initial viscosity.

TABLE I

| Exposures* | Storage Time, hr. | Viscosity (cP) at 90° C. and shear rate 7.92 $sec^{-1}$ |
|---|---|---|
| 0 | Initial | 515 |
| 1 | 22 | 646 |
| 2 | 44 | 710 |
| 3 | 69 | 769 |
| 4 | 117 | 849 |
| 5 | 213 | 933 |

*Number of times storage flask was opened for sample extraction.

However, the subsequent viscosity measurements show the increases change linearly with the number of exposures irrespective of the storage time. This result quantitively substantiates the fact that the viscosity increase during residual oil storage in a closed system is largely due to the loss of the volatile components as they equilibrate within the vapor space in the storage vessel.

EXAMPLE 2

The following example illustrates the loss of volatile component from the residual oil and its impact on the residual oil viscosity. Residual oil of known initial viscosity stored in a drum was transferred to four four-ounce open bottles so that each contained from 28 to 32 grams of material. The bottles were stored at 82° C. and at different storage time intervals, each bottle was taken out of the oven and mixed thoroughly. The weight loss and the increase in viscosity of the residual oil was then immediately determined. The results are set forth in the following TABLE II where it can be seen that a loss of 1.9 percent by weight of the volatile results in an increase of residual oil viscosity of more than 80 percent.

TABLE II

| Volatiles Loss, wt % | Shear Rate ($sec^{-1}$) | Viscosity (cP) at 82° C. |
|---|---|---|
| Initial | 7.92 | 1148 |
| | 3.96 | 1175 |
| 0.64 | 3.96 | 1313 |
| | 1.98 | 1340 |
| 1.08 | 3.96 | 1631 |
| | 1.98 | 1670 |
| 1.60 | 3.96 | 1938 |
| | 1.98 | 1985 |
| 1.92 | 3.96 | 2149 |
| | 1.98 | 2200 |

EXAMPLE 3

In order to illustrate the effect of the viscosity repressor, a known quantity of residual oil from the same source drum as in Example 2 was prepared both with and without 1.83 percent by weight of cresol added thereto. The samples were stored under constant stirring at 93° C. in a three-necked round bottom 500 milliliter flask equipped with a condenser and a thermometer. A slight nitrogen back pressure was maintained at the top of the condenser. At specific intervals about 10 milliliters of the sample was withdrawn from the storage flask and the viscosity of the sample was measured at 93° C. An exposure time of five minutes was maintained for each extraction.

TABLE III

| Sample | Storage Time (hr) | Shear Rate ($sec^{-1}$) | Viscosity @ 200° F. (cP) |
|---|---|---|---|
| Without cresol | 0 | 15.84 | 324 |
| | | 7.92 | 331 |
| | 18 | 15.84 | 417 |
| | | 7.92 | 428 |
| | 20 | 15.84 | 418 |
| | | 7.92 | 431 |
| | 24 | 15.84 | 434 |
| | | 7.92 | 443 |
| With cresol | 0 | 7.92 | 228 |
| | 18 | 15.84 | 243 |
| | 20 | 15.84 | 249 |
| | | 7.92 | 257 |
| | 24 | 15.84 | 262 |
| | | 7.92 | 268 |

TABLE III summarizes the viscosity change of the residual oil with and without the cresol additive. It was noted that cresol is completely soluable in the residual oil and upon addition lowers the initial viscosity of the residual oil by about 30 percent.

To further evaluate the effect of cresol additive on the viscosity of the residual oil, various quantities of cresol in the range of 1–5 percent by weight were thoroughly mixed with known quantities of residual oil of known viscosity in separate four-ounce vials. The viscosity of each mixture was then determined immediately. The results are shown in TABLE IV.

TABLE IV

| Cresol Concentration (wt %) | Shear Rate ($sec^{-1}$) | Viscosity at 180° F. (cP) |
|---|---|---|
| 0 | 7.92 | 1049 |
| | 3.96 | 1118 |
| 1.12 | 7.92 | 866 |
| | 3.96 | 880 |
| 2.08 | 7.92 | 763 |
| | 3.96 | 778 |
| 3.11 | 15.84 | 465 |
| | 7.92 | 473 |
| 5.19 | 15.84 | 301 |
| | 7.92 | 306 |

EXAMPLE 4

Samples of a well-mixed residual oil of known viscosity containing 1.81 percent of cresol were transferred to three four-ounce vials. Each vial contained approximately the same amount of mixture. The viscosity of one of the vials was measured while the other two open vials were stored in the oven at 82° C. At different storage times, the vials were taken out of the oven, mixed thoroughly, and the weight loss and viscosity were determined. The results are shown in the following TABLE V:

TABLE V

| Sample | Weight Loss (wt %) | Shear Rate ($sec^{-1}$) | Viscosity at 180° F. (cP) |
|---|---|---|---|
| Residual Oil | initial | 7.92 | 996 |
| | | 3.96 | 1013 |
| Residual Oil + | initial | 7.92 | 670 |
| 1.81 wt % | | 3.96 | 683 |
| Cresol | 0.99 | 7.92 | 755 |
| | | 3.96 | 773 |
| | 2.08 | 7.92 | 1048 |
| | | 3.96 | 1070 |

From the foregoing examples, it is clear that the rate of viscosity increase to volatile loss is higher for the residual oils without cresol additive than with cresol additive. It can also be seen that the viscosity decrease due to the addition of 1.8 percent cresol is equivalent to the viscosity increase due to a 1.8 percent by weight loss of volatile materials within the residual oil sample. These results indicate that the presence of cresol as an additive minimizes the release of the inherent residual oil volatile component during storage. Further, the volatiles that are lost from the residual oil that does not have additive increases the viscosity significantly more than would be expected due to a change in composition. This supports the conclusion that the use of cresol as an additive minimizes the loss of inherent residual oil volatiles during storage and reduces the magnitude of viscosity increase due to volatile loss.

As will be apparent to persons skilled in the art, various modifications, adaptations, and variations of the foregoing specific disclosure can be made without departing from the teachings of the present invention.

What is claimed is:

1. A process for stabilizing the viscosity during handling and storage at temperatures of 35°–150° C. for a period of time up to about four months of a homogeneous, single phrase blend of solvent refined coal and solvent refined coal liquid distillate which liquid distillate contains indigenous nitrogen base compounds, both derived via liquefaction of a coal feed stock, which process for viscosity stabilization comprises:

(a) adding to said blend of solvent refined coal and solvent refined coal liquid distillate up to about 5.0 percent by weight of a light volatile phenolic viscosity repressor;

(b) passing said blend of solvent refined and solvent refined coal liquid distillate containing said light volatile phenolic viscosity repressor to a storage container while minimizing the loss of light volatile components present therein; and, (c) maintaining a partial pressure of said phenolic viscosity repressor over said stored blend of solvent refined coal and solvent refined coal liquid distillate throughout storage of said blend to insure that said phenolic viscosity repressor attaches to nitrogen base compounds contained within said blend of solvent refined coal and solvent refined coal liquid distillate to negate a large increase in viscosity.

2. The process of claim 1 wherein the phenolic viscosity repressor is selected from the group consisting of phenol, alkyl substituted phenol wherein the alkyl radical has 1–5 carbon atoms and mixtures thereof.

3. The process of claim 1 wherein the phenolic viscosity repressor has a boiling point up to about 260° C.

4. The process of claim 1 wherein the phenolic viscosity repressor is a cresol.

5. The process of claim 1 wherein the phenolic viscosity repressor is a mixture comprising phenol and alkyl substituted phenols wherein the alkyl radical has 1–5 carbon atoms.

6. The process of claim 5 wherein the mixture is solvent refined coal and a light oil derived therefrom and the light volatile phenolic viscosity repressor is added in amounts up to about 2.0 percent by weight.

7. The process of claim 1 wherein the phenolic viscosity repressor has a boiling point within the range of 145°–260° C. and is added in amounts of 0.5–2.0 percent by weight.

8. The process of claim 1 wherein the loss of said volatile components is minimized by blanketing said blend of said solvent refined coal and said distillate oil with an inert atmosphere.

9. The process of claim 1 wherein the loss of volatile components is minimized by blanketing said blend of said solvent refined coal and said distillate oil with a water layer at a temperature of about 65° C. or lower.

10. The process of claim 1 wherein said water layer contains said phenolic viscosity repressor.

11. The process of claim 1 wherein said blend of said solvent refined coal and distillate oil are maintained at 35°–150° C. with minimal agitation.

12. The process of claim 1 wherein the partial pressure of said phenolic viscosity repressor is maintained in part by reflux condensation and reinjection of the condensate into the blend of said solvent refined coal and said distillate oil.

* * * * *